US011480364B2

(12) United States Patent
Ewert et al.

(10) Patent No.: US 11,480,364 B2
(45) Date of Patent: Oct. 25, 2022

(54) FLAMELESS HEATER SYSTEM TO GENERATE HEAT AND HUMIDITY

(71) Applicant: Anderson Industries, LLC, Webster, SD (US)

(72) Inventors: Daniel Ewert, Lake Park, MN (US); Joel Jorgenson, Fargo, ND (US)

(73) Assignee: Anderson Industries, LLC, Webster, SD (US)

( * ) Notice: Subject to any disclaimer, the term of this patent is extended or adjusted under 35 U.S.C. 154(b) by 1004 days.

(21) Appl. No.: 16/200,471

(22) Filed: Nov. 26, 2018

(65) Prior Publication Data

US 2019/0162448 A1 May 30, 2019

Related U.S. Application Data

(60) Provisional application No. 62/591,612, filed on Nov. 28, 2017.

(51) Int. Cl.
*F24H 9/20* (2022.01)
*H05B 6/10* (2006.01)
(Continued)

(52) U.S. Cl.
CPC ..... *F24H 9/2071* (2013.01); *F24F 6/18* (2013.01); *F24F 11/0008* (2013.01); *F24H 3/022* (2013.01); *H05B 6/108* (2013.01)

(58) Field of Classification Search
CPC ..... F24H 9/2071; F24H 3/022; F24F 6/18; F24F 11/0008; H05B 6/108
(Continued)

(56) References Cited

U.S. PATENT DOCUMENTS 6,008,482 A * 12/1999 Takahashi ..... F22B 1/287 219/687
9,677,780 B2 * 6/2017 Nakagawa ..... F24F 11/46
(Continued)

FOREIGN PATENT DOCUMENTS

EA 013856 B1 8/2010
RU 108564 U1 9/2011
(Continued)

OTHER PUBLICATIONS

Transmittal of International Preliminary Report on Patentability dated Jun. 2, 2020, for PCT/US2018/062602, filed Nov. 27, 2018, 6 pages.

(Continued)

*Primary Examiner* — Phuong T Nguyen
(74) *Attorney, Agent, or Firm* — Womble Bond Dickinson (US) LLP

(57) ABSTRACT

A flameless heater system is described. The flameless heater system includes an energy source configured to generate energy and a heating system operatively coupled to the energy source, the heating system being configured to convert the energy to heat. The flameless heater system further includes a humidifying system operatively coupled to the energy source, the humidifying system being configured to convert the energy into moisture and a control system operatively coupled to the energy source, the heating system and the humidifying system, the control system being configured to monitor and control the energy source, the heating system and the humidifying system.

17 Claims, 8 Drawing Sheets

(51) Int. Cl.
*F24F 11/00* (2018.01)
*F24F 6/18* (2006.01)
*F24H 3/02* (2022.01)

(58) Field of Classification Search
USPC ..... 219/629, 681, 682, 684, 685, 687, 731, 219/759, 772, 628; 392/302, 314, 303, 392/311, 324, 347, 360, 407, 465
See application file for complete search history.

(56) References Cited

U.S. PATENT DOCUMENTS

2007/0006529 A1* 1/2007 Wunning ..... B01J 8/0469 48/198.7
2011/0056384 A1* 3/2011 Kadota ..... F24F 3/1417 96/407
2015/0019024 A1* 1/2015 Sabripour ..... G06F 3/0484 700/276
2015/0086933 A1* 3/2015 Bell ..... F28D 21/001 432/29
2015/0322857 A1 11/2015 Ethier et al.
2015/0323203 A1* 11/2015 Gerber ..... F24F 11/83 62/94
2016/0025578 A1* 1/2016 Meirav ..... G01K 17/06 374/40
2016/0161147 A1* 6/2016 Lorenson ..... F24H 3/06 123/41.49

FOREIGN PATENT DOCUMENTS

RU 2523212 C2 7/2014
RU 2628277 C1 8/2017

OTHER PUBLICATIONS

International Search Report and Written Opinion dated Feb. 28, 2019 for International application No. PCT/US2018/062602.

* cited by examiner

FLAMELESS HEATER SYSTEM TO GENERATE HEAT AND HUMIDITY

CROSS REFERENCE TO RELATED APPLICATIONS

This application claims the benefit of an earlier filing date of U.S. Provisional Patent Application No. 62/591,612, filed on Nov. 28, 2017, the disclosure of which is incorporated herein by reference in its entirety.

TECHNICAL FIELD

Aspects and implementations of the present disclosure relate to flameless heater systems.

BACKGROUND

Flameless heaters have been used to provide heat in harsh and potentially hazardous conditions. These heaters must be able to operate in extreme conditions for extended periods of time without operator control and monitoring, in various temperatures and weather conditions. The requirement of flameless heat is essential in certain locations, as wellhead gases may be volatile and an ignition source, such as a spark or open flame, could set off an uncontrolled fire.

BRIEF DESCRIPTION OF THE DRAWINGS

Embodiments and implementations of the present disclosure will be understood more fully from the detailed description given below and from the accompanying drawings of various aspects and implementations of the disclosure, which, however, should not be taken to limit the disclosure to the specific embodiments or implementations, but are for explanation and understanding only.

DETAILED DESCRIPTION

Aspects and implementations of the present disclosure are directed to a flameless heater system. Flameless heaters are used to provide heat in harsh and potentially hazardous environments, such as oil fields or grain drying. Flameless heaters operate in environments that include volatile gasses that may be ignited by an ignition source, such as a spark or an open flame. The use of flameless heaters in such environments reduce the risk of explosions or uncontrolled fires by providing heat without the use of an ignition source.

One example of a flameless heater system utilizes an internal combustion engine to drive a fluid based heat generator. The heat generator shears a fluid, causing the fluid to heat. The heated fluid is then circulated through hoses using an engine-driven pump to a storage tank. The heated fluid is then transferred from the storage tank to a fluid-to-air heat exchanger, where the heat is extracted from the heated fluid. Another example of a flameless heater system utilizes an internal combustion engine to drive a fan while moving magnets to create heat. A third example of a flameless heater system utilizes a fuel cell to generate electricity which is provided to a heating element.

However, elevating the temperature of ambient air using a flameless heater reduces the relative humidity of the ambient air to near zero. The lack of moisture in the ambient air may be undesirable for particular implementations of a flameless heater system. For example, using a flameless heater to provide dry ambient air for the kill stage of the decontamination of organic foods may cause the foods to dry out, resulting in unfavorable changes in the flavor of the food. In another example, various decontamination processes on aircraft, homes, hotels, etc. may require both high humidity and high heat to kill certain bacteria, mold and viruses. Accordingly, a conventional flameless heater system that provides dry ambient air may not be suitable for such purposes.

Embodiments of the present disclosure address the issues of conventional flameless heater systems by implementing systems and controls to introduce moisture into heated air produced by a flameless heater system. By utilizing a humidity system, moisture may be added to a heated air output airstream produced by a flameless heater system, increasing the relative humidity of the output airstream. The result is an improved flameless heater system that generates heat and humidity, improving the performance of the flameless heater system and allowing the flameless heater system to be used in various processes, such as food decontamination, where a conventional flameless heater system may be insufficient.

Figure 1:
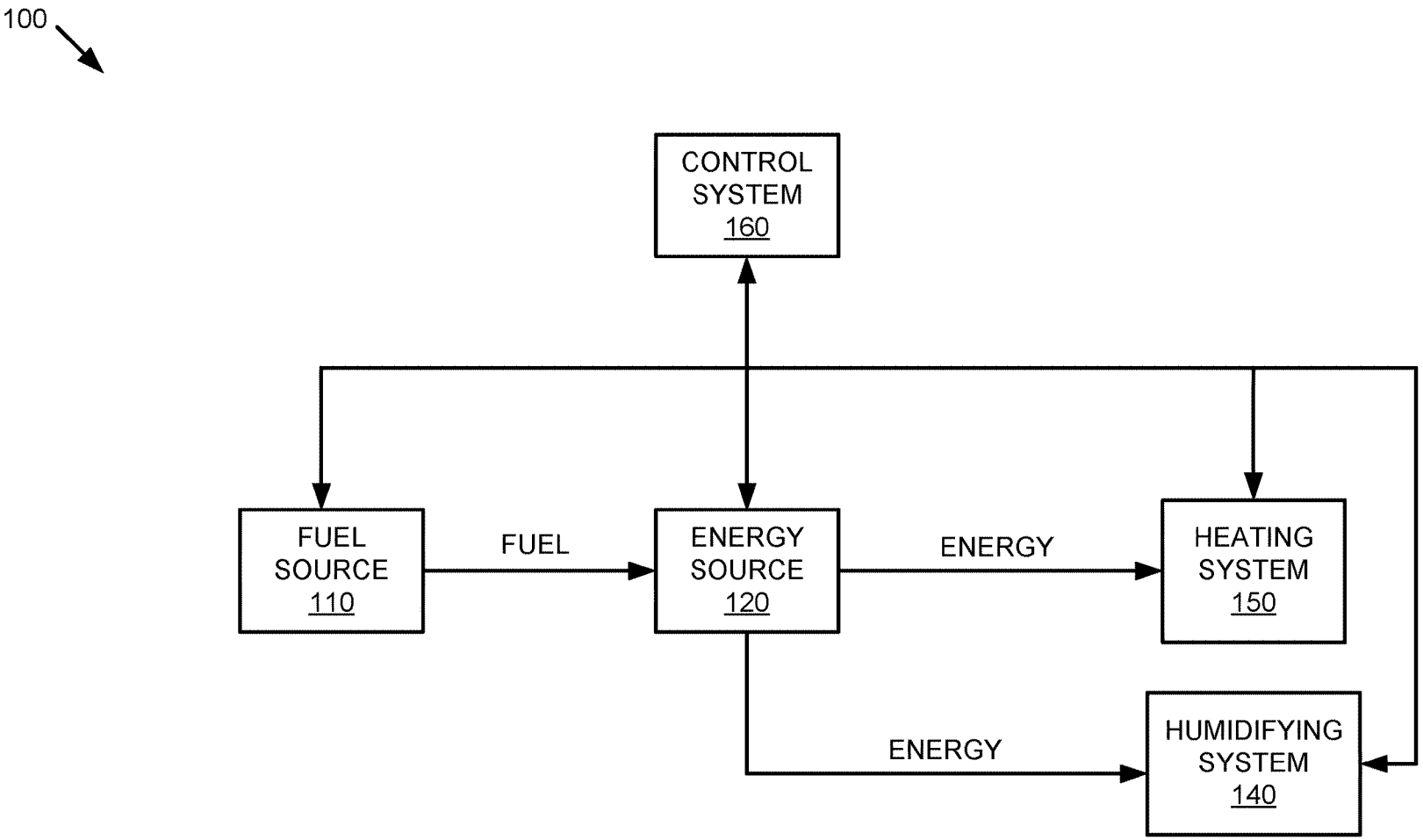
FIG. 1 illustrates a configuration of a flameless heater system in accordance with embodiments of the present disclosure.

FIG. 1 illustrates a configuration of a flameless heater system 100 in accordance with embodiments of the present disclosure. The flameless heater system 100 may include a fuel source 110, an energy source 120, a humidifying system 140, a heating system 150 and a control system 160.

The control system 160 may be operatively coupled to the fuel source 110, the energy source 120, the humidifying system 140 and the heating system 150. The control system 160 may also be operatively coupled to one or more sensors (not shown) that gather data on various parameters of flameless heater system 100. The control system 160 includes a processing device configured to monitor the various parameters of flameless heater system 100 and control various operations of flameless heater system 100. For example, the control system 160 may monitor the heat output of heating system 150, the fuel level of fuel source 110, the power output of energy source 120, the moisture output of humidifying system 140, etc.

The energy source 120 converts fuel from the fuel source into energy. In embodiments, the energy source 120 may be an internal combustion engine. For example, the energy source 120 may be a diesel engine. In some embodiments, the energy source 120 may be a turbine engine. For example, the energy source 120 may be a jet engine.

In an embodiment, the energy source 120 may be a fuel cell. The fuel cell converts energy from the fuel through an electrochemical reaction of the fuel with oxygen or another oxidizing agent. The fuel cell can include an anode, an electrolyte and a cathode. At the anode a catalyst oxidizes the fuel, turning the fuel into positively charged ions and negatively charged electrons. The positively charged ions pass through the electrolyte, while the negatively charged electrons cannot pass through the electrolyte. The negatively charged electrons travel through a wire to create electric current. The negatively charged electrons are then reunited with the positively charged ions at the cathode, where the negatively charged electrons react with the positively charges ions to produce water vapor and heat. Various types of fuel cells may be used in various embodiments of the present disclosure depending on a type of fuel of the fuel source. Examples of types of fuel cells that may be used include, but are not limited to, proton exchange membrane fuel cells (PEMFCs), phosphoric acid fuel cells (PAFCs), solid acid fuel cells (SAFCs), alkaline fuel cells (AFC), solid oxide fuel cells (SOFCs), molten carbonate fuel cells (MCFCs) and electric storage fuel cells.

The fuel source 110 is a storage system for the fuel that is to be provided to energy source 120. Examples of fuel sources may include, but are not limited to, storage tanks, containers, bladders, reservoirs and the like. The type of fuel stored at fuel source 110 may be based on the type of energy source 120 used by the flameless heater system 100. For example, if energy source 120 is a diesel engine, then fuel source 110 may store diesel fuel. In another example, if energy source 120 is a fuel cell, then fuel source 110 may store a hydrocarbon fuel, such as hydrogen, carbon monoxide, methanol, methane, gasoline, diesel, jet fuel or other hydrocarbon fuels. The fuel source 110 is operatively coupled to the energy source 120 to provide fuel from fuel source 110 to the energy source 120. For example, one or more hoses or tubes may be coupled between the fuel source 110 and the energy source 120 to provide the fuel to the energy source 120. In embodiments, one or more pumps may be utilized to move the fuel from the fuel source 110 to the energy source 120.

Upon receipt of the fuel, the energy source 120 converts the fuel into energy, as previously described. The energy generated by the energy source 120 may be provided to a heating system 150 that is operatively coupled to the energy source 120. The heating system 150 may be configured to convert the energy received from energy source 120 into thermal energy (e.g., heat).

In embodiments, the heating system 150 may be a radiant heater that emits infrared radiation. In an embodiment, the heating system 150 may be a convection heater that utilizes a heating element to heat the air in contact with the heating element by thermal conduction. In some embodiments, the heating system 150 may be a heat pump that utilizes an electrically driven compressor to operate a refrigeration cycle that extracts heat energy from outdoor air, the ground or ground water, and moves the heat into the space to be warmed. In embodiments, the heating system 150 may be an electrical resistance heating element. In some embodiments, the heating system 150 may be a fluid based heat generator configured to shear a fluid to generate heat. In embodiments, the heating system 150 may be an induction heater configured to generate heat by electromagnetic induction. In an embodiment, the heating system 150 may be any device that converts energy generated by energy source 120 into thermal energy.

The energy generated by energy source 120 may further be provided to a humidifying system 140 operatively coupled to energy source 120. The humidifying system 140 may be configured to utilize the energy provided by energy source 120 to add moisture to the heated outflow airstream of the flameless heater system 100. In embodiments, humidifying system 140 may be a boiler configured to utilize the energy provided by the energy source 120 to produce steam that is introduced into the outflow airstream of the flameless heater system 100. In some embodiments, the humidifying system 140 may be a membrane humidifier configured to add moisture into the outflow airstream by flowing the airstream along a wetted membrane. Other examples of humidifying systems 140 that may be utilized by the flameless heater system 100 may include evaporative humidifiers, natural humidifiers, vaporizers, impeller humidifiers, ultrasonic humidifiers, drum humidifiers, disc wheel humidifiers, bypass flow-through humidifiers, spray mist humidifiers and any other type of humidifier configured to add moisture to the outflow airstream.

Figure 2:
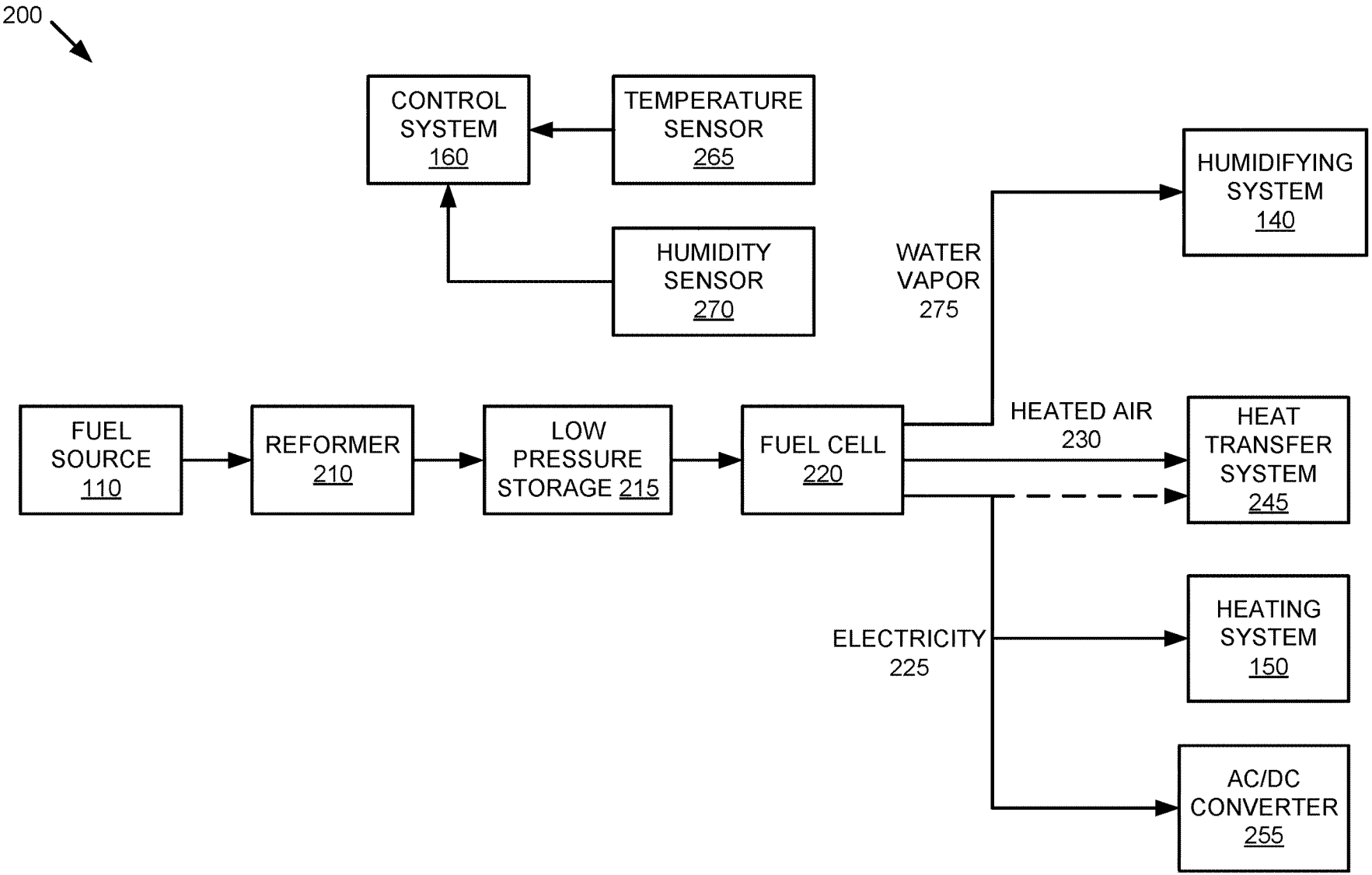
FIG. 2 illustrates a configuration of a flameless heater system utilizing a fuel cell energy source in accordance with one embodiment of the present disclosure.

FIG. 2 illustrates a configuration of a flameless heater system 200 utilizing a fuel cell energy source in accordance with one embodiment of the present disclosure. The flameless heater system 200 includes fuel source 110, humidifying system 140, heating system 150 and control system 160, as previously described at FIG. 1. For illustrative purposes, flameless heater system 200 will be described with fuel source 110 storing methanol as the fuel type. However, embodiments of the disclosure may use any fuel types.

A reformer 210 may be operatively coupled to fuel source 110. The reformer 210 may be configured to extract hydrogen from the methanol fuel provided by fuel source 110. An example reformer 210 may be a steam reformer that is configured to cause a reaction between steam at a high temperature and pressure with a hydrocarbon fuel source, such as methanol, in the presence of a nickel catalyst. In embodiments, other types of reformers 210 may be used to extract hydrogen from a hydrocarbon fuel source.

Upon extraction of the hydrogen from the methanol fuel by the reformer 210, the extracted hydrogen may be provided to a low pressure storage 215 that is operatively coupled to the reformer 210. Low pressure storage 215 may be a storage system, such as a storage tank or container, which is configured to store the extracted hydrogen at low pressures of approximately one atmosphere. The low pressure storage 215 may provide additional advantages to the flameless heater system 200 since storing the extracted hydrogen at a low pressure greatly reduces the risk of explosion and, in the event that the low pressure storage 215 is ruptured, the hydrogen will be released at a much slower rate than a pressurized hydrogen storage system. In some embodiments, rather than storing the extracted hydrogen at the low pressure storage 215, the extracted hydrogen may be provided directly from reformer 210 to fuel cell 220.

The low pressure storage system 215 may be operatively coupled to the fuel cell 220 to provide the extracted hydrogen stored at the low pressure storage system 215 to the fuel cell 220. The fuel cell 220 may generate electricity 225 using the extracted hydrogen, as previously described. Other byproducts of the reaction within the fuel cell 220 may include water vapor 275 and thermal energy (e.g., heated air 230). Embodiments of the disclosure may capture and utilize these byproducts, providing further advantages over a conventional flameless heater system.

In embodiments, humidifying system 140 may be operatively coupled to fuel cell 220. Water vapor 275 that is the result of the reaction that takes place in the fuel cell 220 to generate electricity 225 may be provided from the fuel cell 220 to the humidifying system 140. Embodiments of the disclosure may reduce the need for water to be provided from an outside source to humidify the outflow airstream by utilizing the water vapor byproduct of the fuel cell 120 reaction to add moisture to the outflow airstream, providing further advantages over a conventional flameless heater system. The humidifying system 140 may be configured to convert the electricity 225 and water vapor 275 generated by fuel cell 220 into moisture that may be added to the outflow airstream of the flameless heater system 200, as previously described. In some embodiments, water from an outside source (not shown) may be provided to the humidifying system 140 to supplement water vapor 275.

In some embodiments, the heated air 230 generated by the reaction that takes place in the fuel cell 220 to generate electricity 225 may also be used as a heat source to supplement the heat generated by heating system 150. The heated air 230 may be provided to a heat transfer system 245 operatively coupled to the fuel cell 220. The heat transfer system 245 may be configured to move the heated air 230 from the fuel cell 220 to a desired location. In an embodiment, the heat transfer system 245 may include one or more fans that are configured to move the heated air 230. In embodiments, the heat transfer system 245 may include one or more pumps that are configured to move the heated air 230. In some embodiments, the heat transfer system 245 may include a radiator that is configured to transfer the thermal energy of the heated air produced by the fuel cell to a desired location. In embodiments, electricity 225 generated by the fuel cell 220 may be provided to the heat transfer system 245 to power various components of the heat transfer system 245. For example, the electricity 225 may be used to power the fans, pumps, etc. of the heat transfer system 245. In some embodiments, the heated air 230 moved by the heat transfer system may be combined in the outflow airstream of the flameless heater system 200 with the heat generated by heating system 150.

The electricity 225 generated by fuel cell 220 may be provided to a heating system 150 that is operatively coupled to the fuel cell 220, as previously described. In embodiments, an alternating current to direct current (AC/DC) converter 255 may be operatively coupled to the fuel cell 220. When a fuel cell 220 generates electricity 225, the electricity 225 is direct current. The AC/DC converter 255 may receive the electricity 225 and convert the electricity from direct current to alternating current. Once converted to alternating current, the electricity 225 may be used to power various ancillary devices.

Flameless heater system 200 may include one or more temperature sensors 265. In embodiments, the temperature sensor 265 may be configured to measure a temperature of a volume of space being heated by the flameless heater system 200. The temperature sensor 265 may be operatively coupled to the control system 160 to provide the measured temperatures to the control system 160. The control system 160 may utilize the measured temperatures to adjust parameters and/or operations of the flameless heater system 200, as will be described in further detail below.

Flameless heater system 200 may further include one or more humidity sensors 270. In embodiments, the humidity sensor 270 may be configured to measure the humidity of a volume of space being humidified by the flameless heater system 200. The humidity sensor 270 may be operatively coupled to the control system 160 to provide the measured humidity to the control system 160. The control system 160 may utilize the measured humidity to adjust parameters and/or operations of the flameless heater system 200, as will be described in further detail below.

Figure 3:
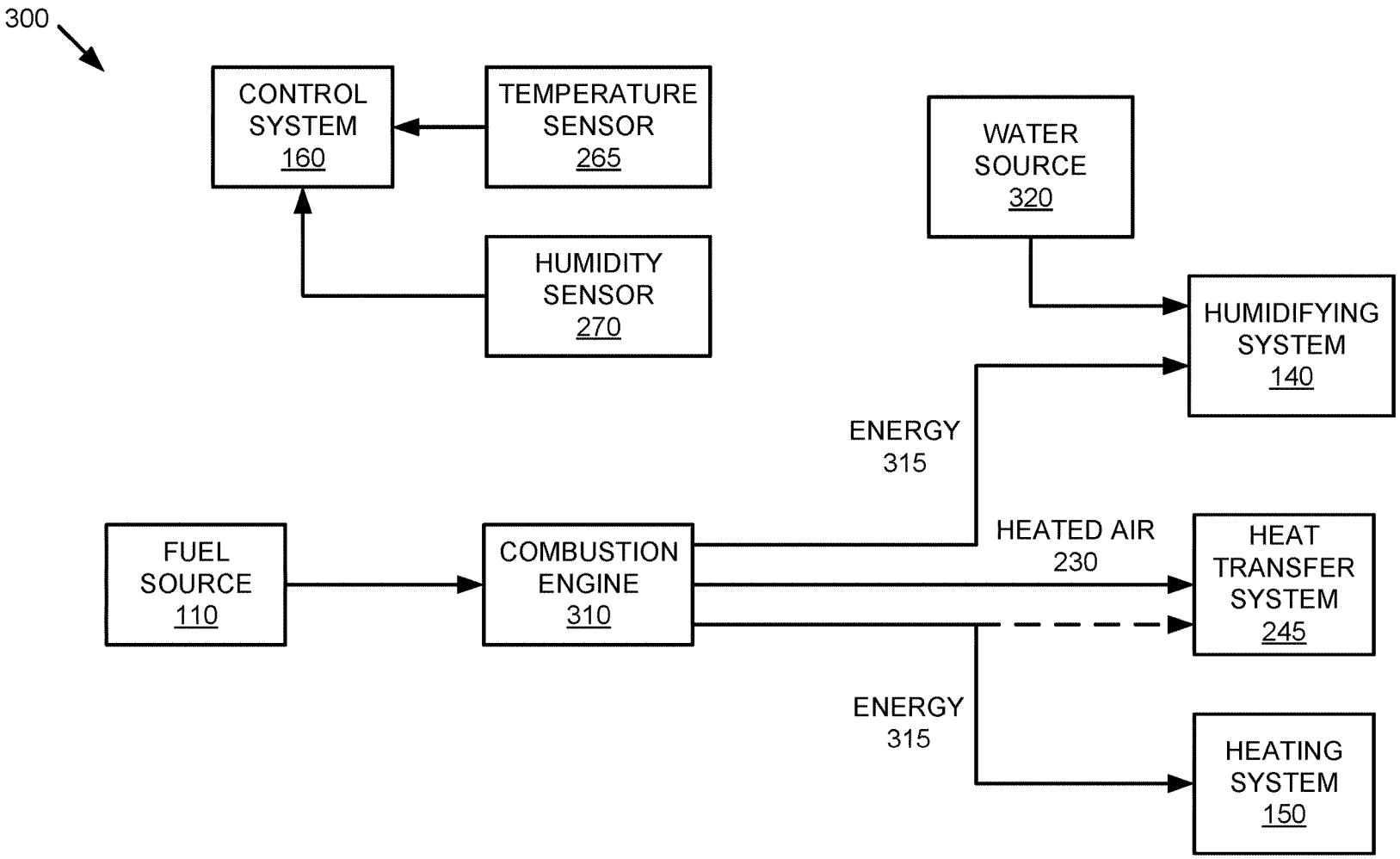
FIG. 3 illustrates a configuration of a flameless heater system utilizing an internal combustion engine energy source in accordance with one embodiment of the present disclosure.

FIG. 3 illustrates a configuration of a flameless heater system 300 utilizing an internal combustion engine energy source in accordance with one embodiment of the present disclosure. The flameless heater system 200 includes fuel source 110, humidifying system 140, heating system 150 and control system 160, as previously described at FIG. 1.

The fuel source 110 may be operatively coupled to an internal combustion engine 310 to provide fuel stored at the fuel source 110 to the internal combustion engine 310. In embodiments, the internal combustion engine 310 may be a reciprocating engine, such as a diesel engine. In some embodiments, the internal combustion engine 310 may be a turbine engine, such as a jet engine. The internal combustion engine 310 may generate energy 315 using the fuel, as previously described. Another byproduct of the generation of energy 315 by the combustion engine 310 may be thermal energy (e.g., heated air 230).

In embodiments, humidifying system 140 may be operatively coupled to the internal combustion engine 310. The humidifying system 140 may be configured to utilize the energy 315 generated by the internal combustion engine 310 to add moisture to the outflow airstream of the flameless heater system 300, as previously described. A water source 320 is a storage system that may be operatively coupled to the humidifying system 140 to provide water to the humidifying system 140. Examples of water sources may include, but are not limited to, storage tanks, containers, bladders, reservoirs, plumbing systems and the like.

In some embodiments, the heated air 230 generated by the internal combustion engine 310 may also be used as a heat source to supplement the heat generated by heating system 150, as previously described.

The energy 315 generated by the internal combustion engine 310 may be provided to a heating system 150 that is operatively coupled to the internal combustion engine 310. The heating system 150 may convert energy 315 into heat, as previously described.

Flameless heater system 300 may include one or more temperature sensors 265 and one or more humidity sensors 270 operatively coupled to the control system 160, as previously described at FIG. 2.

Figure 4:
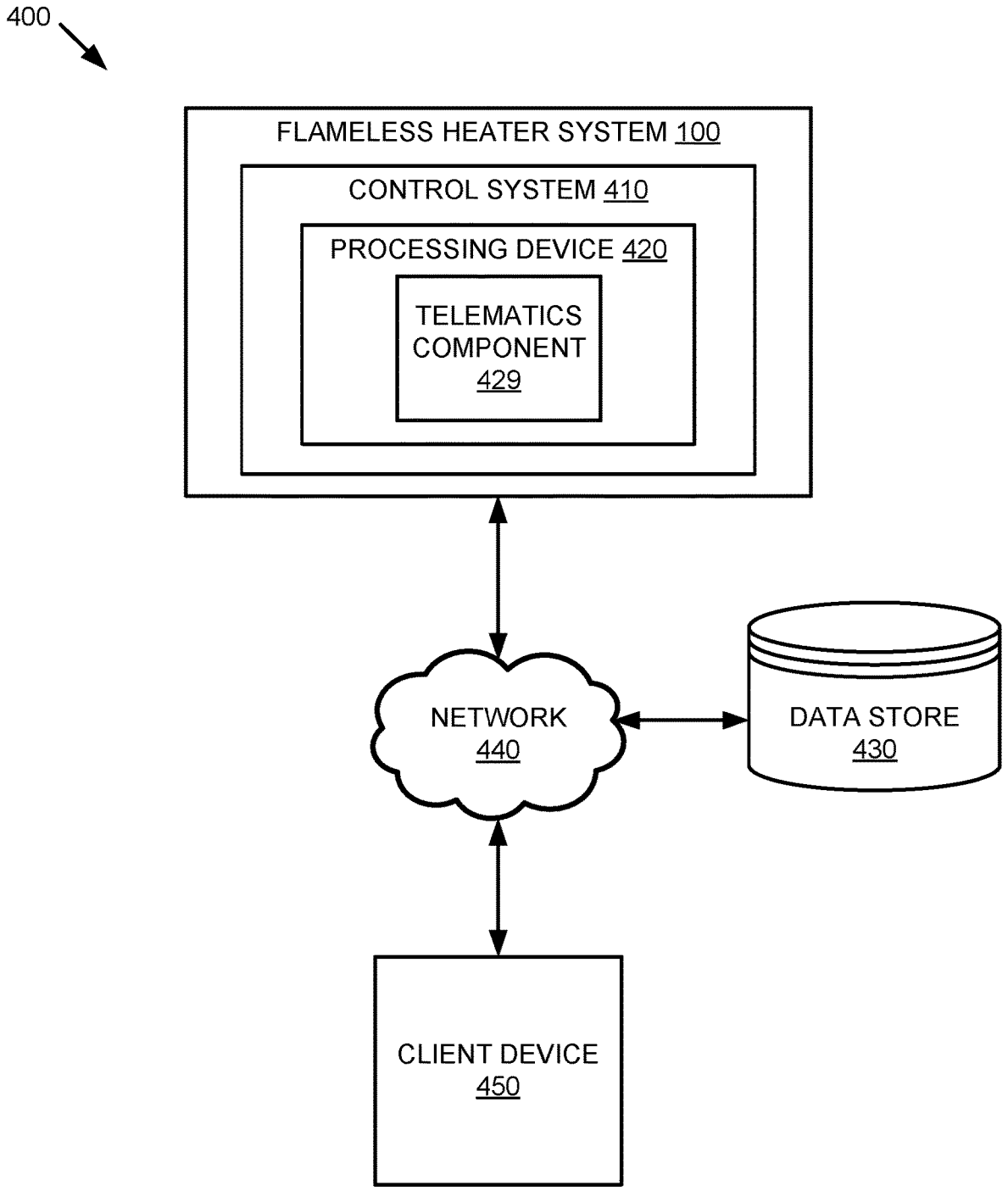
FIG. 4 is a block diagram that illustrates an example of a telematics system in accordance with an embodiment of the present disclosure.

FIG. 4 is a block diagram that illustrates an example of a telematics system 400, in accordance with an embodiment of the present disclosure. The telematics system 400 may include a control system 410 of a flameless heater system 100, as previously described with respect to FIGS. 1-3. The control system 410 includes a processing device 420 that executes a telematics component 429. In embodiments, the control system 410 may be operatively coupled to a data store 430 and a client device 450 via a network 440. In some embodiments, the data store 430 may reside in the control system 410.

The network 440 may be a public network (e.g., the internet), a private network (e.g., a local area network (LAN) or wide area network (WAN)), or a combination thereof. In one embodiment, network 440 may include a wired or a wireless infrastructure, which may be provided by one or more wireless communications systems, such as a wireless fidelity (WiFi) hotspot connected with the network 440 and/or a wireless carrier system that can be implemented using various data processing equipment, communication towers (e.g. cell towers), etc.

The client device 450 may be a computing device, such as a personal computer, laptop, cellular phone, personal digital assistant (PDA), gaming console, tablet, etc. In embodiments, the client device 450 may be associated with a technician for the rotary vacuum drum dryer system 100.

The data store 430 may be a persistent storage that is capable of storing data (e.g., parameters associated with a flameless heater system 100, as described herein). A persistent storage may be a local storage unit or a remote storage unit. Persistent storage may be a magnetic storage unit, optical storage unit, solid state storage unit, electronic storage units (main memory), or similar storage unit. Persistent storage may also be a monolithic/single device or a distributed set of devices.

In embodiments, data store 430 may be a central server or a cloud-based storage system including a processing device (not shown). The central server or the cloud-based storage system may be accessed by control system 410 and/or client device 450. Parameters from the flameless heater system 100 may be transmitted to the data store 430 for storage. In embodiments, upon receipt of the parameters, the data store 430 may transmit the parameters to client device 450. In some embodiments, the parameters stored at the data store may be accessed by client device 450 via a user interface. For example, the data store 430 may generate a graphical user interface (GUI) to present the parameters of the flameless heater system 100 to client device 450. In embodiments, client device 450 may provide adjustments to one or more parameters of the flameless heater system 100 to the data store 430. In some embodiments, upon receipt of the adjustments, the data store 430 may transmit the adjustments to the parameters to control system 410. In some embodiments, the adjustments to the parameters may be accessed by control system 410 via a user interface.

In embodiments, telematics component 429 may transmit parameters of a flameless heater system to client device 450. Telematics component 429 may receive, from client device 450, one or more adjustments to one or more parameters of the flameless heater system.

Figure 5:
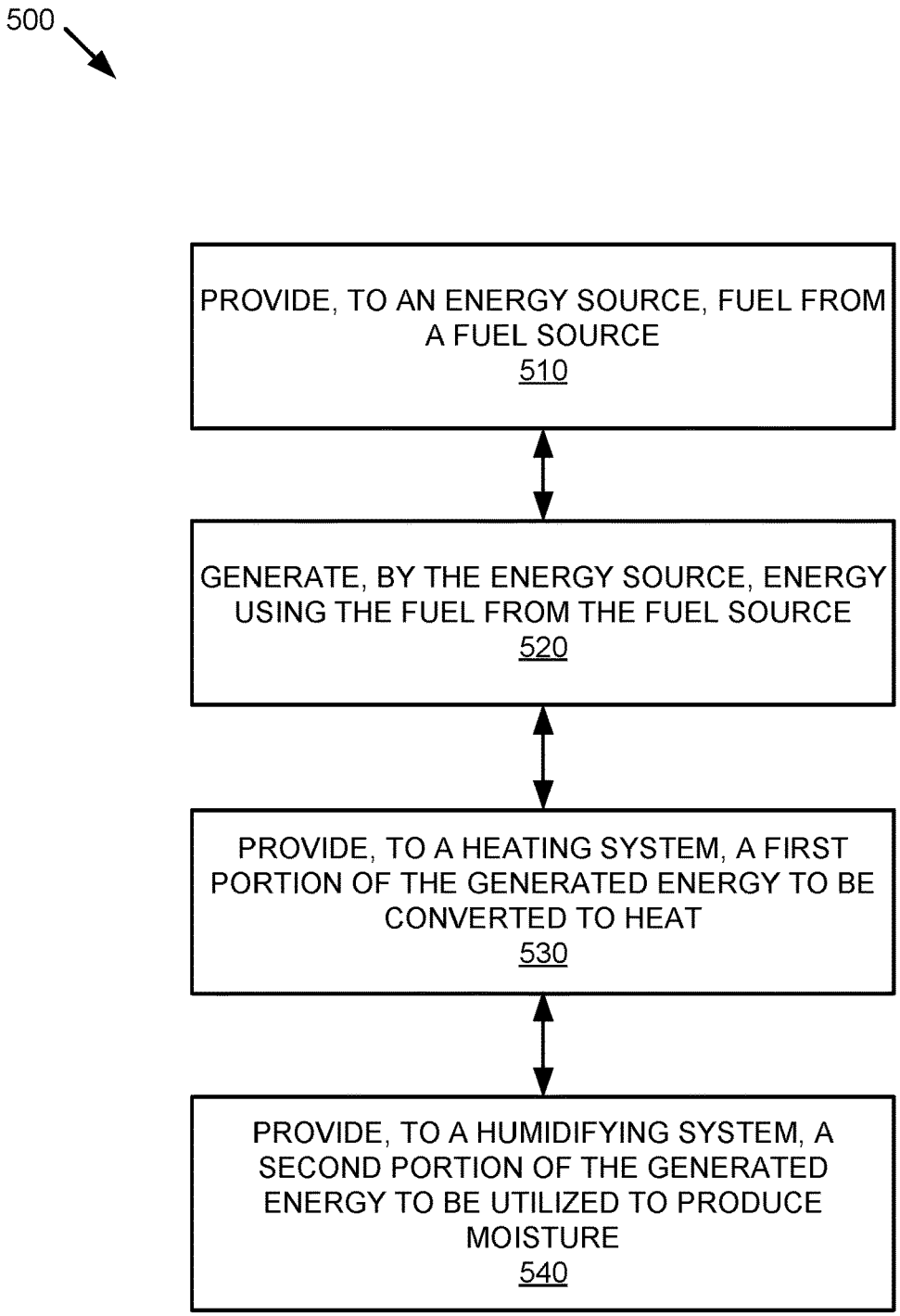
FIG. 5 depicts a flow diagram of a method for utilizing a flameless heater to generate heat and humidity in accordance with one implementation of the present disclosure.

FIG. 5 depicts a flow diagram of a method 500 for utilizing a flameless heater to generate heat and humidity in accordance with one implementation of the present disclosure. In embodiments, various portions of method 500 may be performed by flameless heater system 100 of FIG. 1.

With reference to FIG. 5, method 500 illustrates example functions used by various embodiments. Although specific function blocks ("blocks") are disclosed in method 500, such blocks are examples. That is, embodiments are well suited to performing various other blocks or variations of the blocks recited in method 500. It is appreciated that the blocks in method 500 may be performed in an order different than presented, and that not all of the blocks in method 500 may be performed.

At block 510, a fuel source provides fuel to an energy source. In embodiments, the energy source may be a fuel cell. In some embodiments, prior to providing the fuel to the fuel cell, hydrogen may be extracted from the fuel stored at the fuel source by a reformer. In embodiments, the extracted hydrogen may be stored at a low pressure storage prior to providing the extracted hydrogen to the fuel cell. In an embodiment, the energy source may be an internal combustion engine.

At block 520, the energy source generates energy using the fuel from the fuel source, as previously described. In embodiments, the energy source may also generate thermal energy (e.g., heated air).

At block 530, the energy source provides a first portion of the generated energy to a heating system that is operatively coupled to the energy source. The heating system may convert the energy generated by the energy source into heat. In embodiments, the heated air generated by the energy source may be moved by a heat transfer system and combined with the heat of the heating system in the outflow airstream of the flameless heater system.

At block 540, the energy source provides a second portion of the generated energy to a humidifying system. The humidifying system may utilize the generated energy to add moisture to the outflow airstream of the flameless heater system, as previously described.

Figure 6:
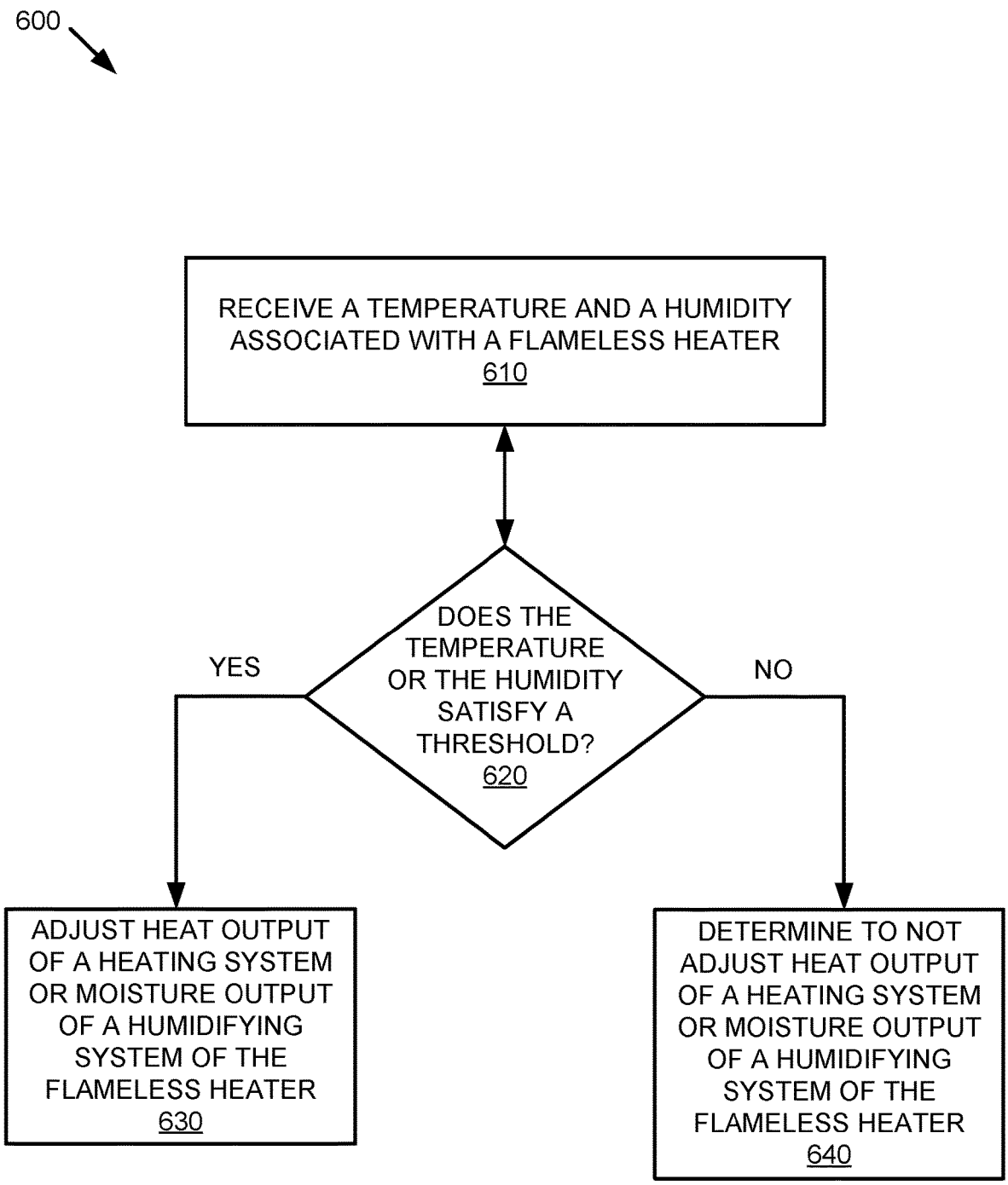
FIG. 6 depicts a flow diagram of a method for controlling a flameless heater system in accordance with implementations of the present disclosure.

FIG. 6 depicts a flow diagram of a method 600 for controlling a flameless heater system in accordance with implementations of the present disclosure. In embodiments, various portions of method 600 may be performed by control system 160 of FIGS. 1-3.

With reference to FIG. 6, method 600 illustrates example functions used by various embodiments. Although specific function blocks ("blocks") are disclosed in method 600, such blocks are examples. That is, embodiments are well suited to performing various other blocks or variations of the blocks recited in method 600. It is appreciated that the blocks in method 600 may be performed in an order different than presented, and that not all of the blocks in method 600 may be performed.

At block 610, a control system (e.g., processing device 802) receives a temperature and a humidity associated with a fuel cell heater. In embodiments, the control system may receive the temperature from one or more temperature sensors of a flameless heater system. In an embodiment, the temperature may correspond to a temperature of a volume of space that is being heated by the flameless heater system. For example, the temperature may correspond to the temperature of a room being heated by the flameless heater system. In some embodiments, the control system may receive the humidity from one or more humidity sensors of the flameless heater system. In embodiments, the humidity may correspond to a humidity of the volume of space that is being humidified by the flameless heater system. For example, the humidity may correspond to the humidity of a room being humidified by the flameless heater system.

At block 620, the control system determines if the temperature and/or the humidity received at block 610 satisfies a threshold. In embodiments, the threshold may correspond to a temperature value. In embodiments, the temperature may satisfy the threshold if the temperature is greater than or equal to the threshold. For example, if the threshold is 72 degrees and the temperature received at block 610 is 75 degrees, then the temperature satisfies the threshold. In some embodiments, the temperature may satisfy the threshold if the temperature is less than or equal to the threshold. For example, if the threshold is 72 degrees and the temperature received at block 610 is 68 degrees, then the temperature satisfies the threshold. In an embodiment, multiple thresholds may be used to create a range of temperatures. For example, a first threshold may be used that specifies a temperature less than or equal to 65 degrees satisfies the first threshold and a second threshold may be used that specifies a temperature greater than or equal to 75 degrees satisfies the second threshold. Accordingly, if the received temperature is outside of the specified temperature range (e.g., is less than or equal to 65 degrees or greater than or equal to 75 degrees), then the temperature satisfies the threshold.

In some embodiments, the threshold may correspond to a humidity value. In embodiments, the humidity may satisfy the threshold if the humidity is less than or equal to the threshold. In an embodiment, the humidity may satisfy the threshold if the humidity is greater than or equal to the threshold. In some embodiments, multiple thresholds may be used for temperature and humidity. For example, the control system may utilize a temperature threshold corresponding to a temperature value and a humidity threshold corresponding to a humidity value. In embodiments, the threshold may be provided via a user interface of the control system. In some embodiments, the threshold may be provided via a temperature regulating device, such as a thermostat.

If the temperature and/or humidity satisfies the threshold, at block 630 the control system adjusts the heat output of a heating system and/or the moisture output of a humidifying system of the flameless heater system. For example, if the temperature received at block 610 is too high (e.g., is greater than the threshold at block 620), then the control system may decrease the heat output of the heating system. In another example, if the temperature received at block 610 is too low (e.g., is less than the threshold at block 620), then the control system may increase the heat output of the heating system.

In embodiments, if the humidity is too high, then the control system may decrease the moisture output of a humidifying system of the flameless heater system. In an embodiment, if the humidity is too low, then the control system may increase the moisture output of the humidifying system.

In embodiments, the control system may adjust the heat output and/or moisture output based on a psychrometric chart. The psychrometric chart may be a graphical representation of parameters of moist air at atmospheric pressure. Examples of parameters that may be utilized by the control system include dry-bulb temperature, wet-bulb temperature, dew point temperature, relative humidity and humidity ratio. The control system may determine one or more of the parameters of the psychrometric chart utilizing one or more sensors operatively coupled to the control system.

If the control system determines the temperature does not satisfy the threshold, at block 640 the control system determines to not adjust the heat output of the heating system and/or the moisture output of the humidifying system of the flameless heater system.

Figure 7:
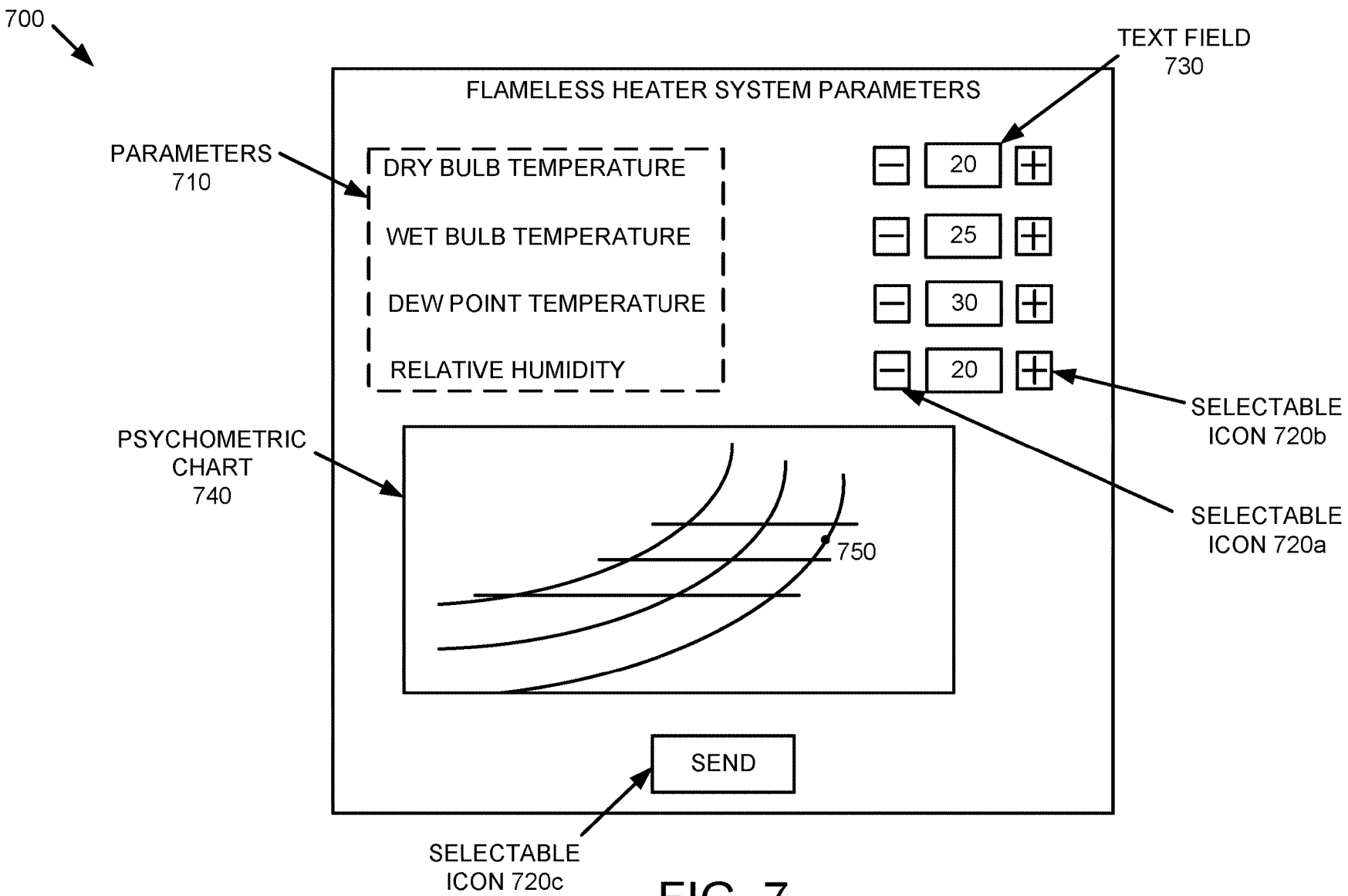
FIG. 7 is an illustration of an example of a user interface to present one or more parameters of a flameless heater system in accordance with embodiments of the disclosure.

FIG. 7 is an illustration of an example of a user interface 700 to present one or more parameters of a flameless heater system in accordance with embodiments of the disclosure. As previously described, in some embodiments a user interface may be generated to present the parameters of a flameless heater system. In embodiments, the user interface 700 may be generated by control system 410. In an embodiment, the user interface 700 may be generated by data store 430. In some embodiments, the user interface 700 may be generated by client device 450.

The user interface 700 may include information associated with one or more parameters 710 of the rotary vacuum drum drying system. Referring to FIG. 7, the parameters 710 presented in the user interface 700 correspond to the dry bulb temperature, the wet bulb temperature, the dew point temperature and the relative humidity of a flameless heater system. It should be noted that the parameters 710 included in user interface 700 are for illustrative purposes only and embodiments of the disclosure may display any combination of parameters of a flameless heater system.

Each of parameters 710 may include a corresponding text field 730. Values presented in text fields 730 may correspond to the received parameters from the flameless heater system. In embodiments, text fields 730 may be selected and an adjustment to the parameter may be entered into the text field 730. For example, a user may select text field 730 that corresponds to the dry bulb temperature and enter an adjustment to adjust the dry bulb temperature from 20 to 25. In embodiments, upon receiving the adjustment, the control system may query a psychrometric chart to determine what adjustments are to be made to the heat output of a heating system and/or moisture output of a humidifying system such that the adjusted parameter is attained.

In some embodiments, user interface 700 may be presented on a display of a control system of the flameless heater system and the input to adjust the parameters of the flameless heater system may be received via the control system. In some embodiments, user interface 700 may be presented on a display of a client device and the input to adjust the parameters of the flameless heater system may be made via the client device. The adjustments may then be sent to the control system of the flameless heater system via a telematics system, as previously described at FIG. 4.

User interface 700 may also include selectable icons 720*a*, 720*b* and 720*c*. Selectable icons 720*a*, 720*b* and 720*c* may be selected by a control system and/or client device to perform a desired action. For example, selectable icon 720*a* may decrease the value of a corresponding parameter when selected. Selectable icon 720*b* may increase the value of the corresponding parameter when selected. In embodiments, selectable icon 720*c* may transmit (e.g., send) a message including adjustments to be made to the parameters of the flameless heater system.

In some embodiments, user interface 700 may include a psychrometric chart 740. In embodiments, a point 750 on the psychrometric chart 740 may be selected and the control system of the flameless heater system may make adjustments to the parameters of the flameless heater system based on the selected point 750. For example, a user may select a particular point 750 on a psychrometric chart 740 via a control system or client device. Upon receiving the selection, the control system may adjust the parameters of the flameless heater system based on the selected point 750 on the psychrometric chart 740.

Figure 8:
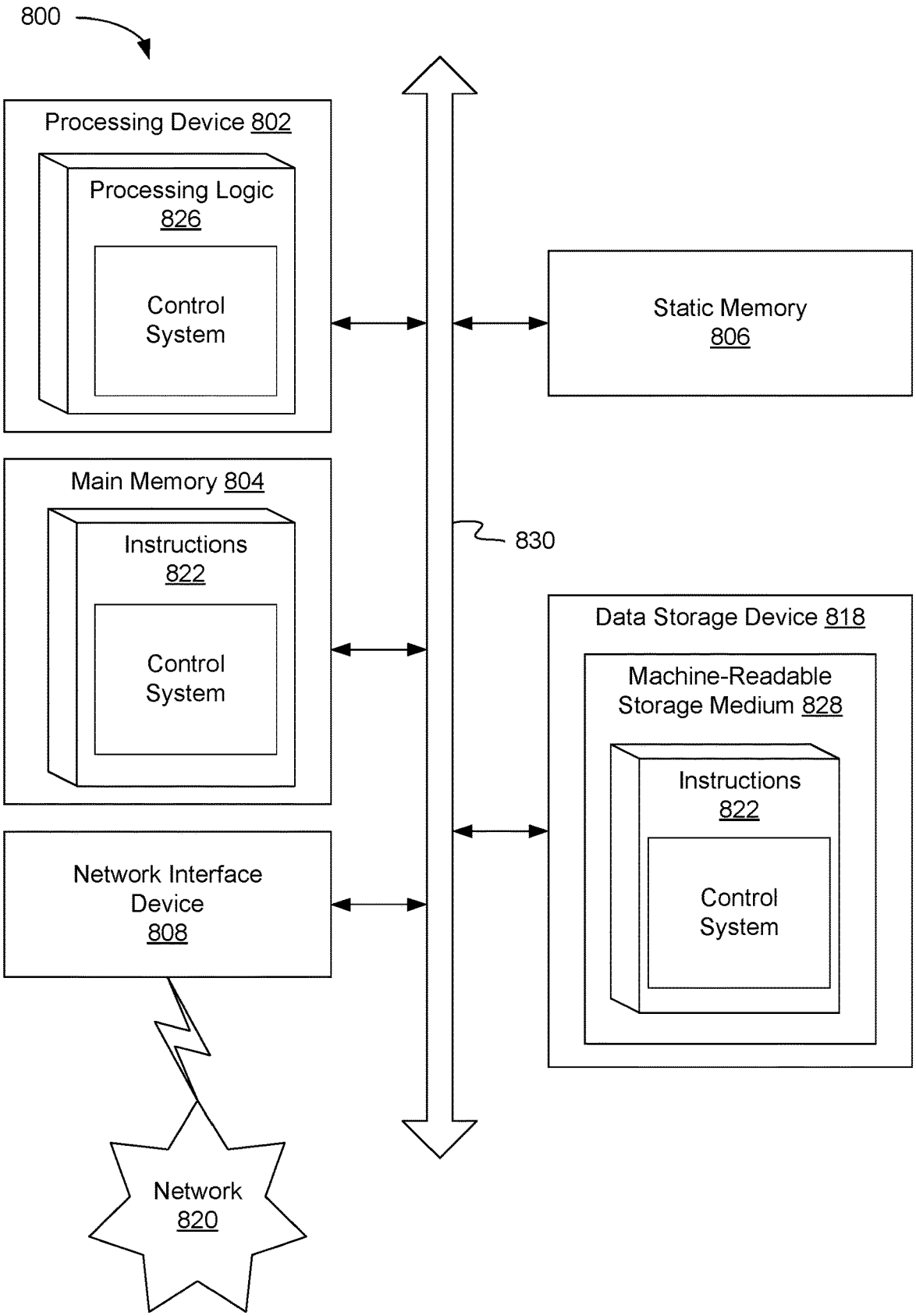
FIG. 8 illustrates a diagrammatic representation of a machine in the example form of a computer system.

FIG. 8 illustrates a diagrammatic representation of a machine in the example form of a computer system 800 within which a set of instructions, for causing the machine to perform any one or more of the methodologies discussed herein, may be executed. In alternative embodiments, the machine may be connected (e.g., networked) to other machines in a local area network (LAN), an intranet, an extranet, or the Internet. The machine may operate in the capacity of a server or a client machine in a client-server network environment, or as a peer machine in a peer-to-peer (or distributed) network environment. The machine may be a personal computer (PC), a tablet PC, a web appliance, a server, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. In one embodiment, computer system 800 may be representative of a server configured to control the operations of flameless heater system 100.

The exemplary computer system 800 includes a processing device 802, a user interface display 813, a main memory 804 (e.g., read-only memory (ROM), flash memory, dynamic random access memory (DRAM), a static memory 806 (e.g., flash memory, static random access memory (SRAM), etc.), and a data storage device 818, which communicate with each other via a bus 830. Any of the signals provided over various buses described herein may be time multiplexed with other signals and provided over one or more common buses. Additionally, the interconnection between circuit components or blocks may be shown as buses or as single signal lines. Each of the buses may alternatively be one or more single signal lines and each of the single signal lines may alternatively be buses.

Processing device 802 represents one or more general-purpose processing devices such as a microprocessor, central processing unit, or the like. More particularly, the processing device may be complex instruction set computing (CISC) microprocessor, reduced instruction set computer (RISC) microprocessor, very long instruction word (VLIW) microprocessor, or processor implementing other instruction sets, or processors implementing a combination of instruction sets. Processing device 802 may also be one or more special-purpose processing devices such as an application specific integrated circuit (ASIC), a field programmable gate array (FPGA), a digital signal processor (DSP), network processor, or the like. The processing device 802 is configured to execute processing logic 826, which may be one example of system 100 as shown in FIG. 1, for performing the operations and blocks discussed herein.

The data storage device 818 may include a machine-readable storage medium 828, on which is stored one or more set of instructions 822 (e.g., software) embodying any one or more of the methodologies of functions described herein, including instructions to cause the processing device 802 to execute a control system (e.g., control system 160). The instructions 822 may also reside, completely or at least partially, within the main memory 804 or within the processing device 802 during execution thereof by the computer system 800; the main memory 804 and the processing device 802 also constituting machine-readable storage media. The instructions 822 may further be transmitted or received over a network 820 via the network interface device 808.

The machine-readable storage medium 828 may also be used to store instructions to perform a method for device identification, as described herein. While the machine-readable storage medium 828 is shown in an exemplary embodiment to be a single medium, the term "machine-readable storage medium" should be taken to include a single medium or multiple media (e.g., a centralized or distributed database, or associated caches and servers) that store the one or more sets of instructions. A machine-readable medium includes any mechanism for storing information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read-only memory (ROM); random-access memory (RAM); erasable programmable memory (e.g., EPROM and EEPROM); flash memory; or another type of medium suitable for storing electronic instructions.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

Reference throughout this specification to "one embodiment" or "an embodiment" means that a particular feature, structure, or characteristic described in connection with the embodiments included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Additionally, some embodiments may be practiced in distributed computing environments where the machine-readable medium is stored on and or executed by more than one computer system. In addition, the information transferred between computer systems may either be pulled or pushed across the communication medium connecting the computer systems.

Embodiments of the claimed subject matter include, but are not limited to, various operations described herein. These operations may be performed by hardware components, software, firmware, or a combination thereof.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent or alternating manner.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation.

What is claimed is:

1. A flameless heater system, comprising:

an energy source configured to generate power;

a heating system operatively coupled to the energy source, the heating system being configured to convert the power to heat;

a humidifying system operatively coupled to the energy source, the humidifying system being configured to utilize the power to produce moisture; and a control system operatively coupled to the energy source, the heating system, and the humidifying system, the control system comprising:

sensors to monitor a power output of the energy source, a heat output of the heating system, and a moisture output of the humidifying system;

a display screen to display a user interface comprising a psychrometric chart, wherein a visible point on the psychrometric chart is selectable to control of the flameless heater system; and a processing device to adjust the power output of the energy source, the heat output of the heating system, and the moisture output of the humidifying system to generate air with a temperature and a humidity corresponding to the point on the psychrometric chart selected by a user.

2. The flameless heater system of claim 1, wherein the sensors comprise:

one or more temperature sensors operatively coupled to the control system, the one or more temperature sensors being configured to measure the temperature of the air generated by the flameless heater system; and one or more humidity sensors operatively coupled to the control system, the one or more humidity sensors being configured to measure the humidity of the air generated by the flameless heater system.

3. The flameless heater system of claim 1, wherein the energy source comprises an internal combustion engine.

4. The flameless heater system of claim 3, further comprising:

a water source operatively coupled to the humidifying system, the water source being configured to provide water to the humidifying system.

5. The flameless heater system of claim 3, wherein the heating system comprises a fluid based heat generator configured to shear a fluid to generate the heat.

6. The flameless heater system of claim 3, wherein the heating system comprises an induction heater configured to generate the heat by electromagnetic induction.

7. The flameless heater system of claim 1, wherein the humidifying system comprises a boiler configured to generate steam.

8. The flameless heater system of claim 1, further comprising:

a fan system operatively coupled to the energy source, the fan system being configured to move heated air produced by the energy source.

9. The flameless heater system of claim 1, wherein the energy source comprises a fuel cell configured to generate the power and water vapor.

10. The flameless heater system of claim 9, further comprising:

a reformer operatively coupled to the fuel cell, the reformer being configured to extract hydrogen from hydrocarbon fuel and provide the extracted hydrogen to the fuel cell.

11. The flameless heater system of claim 9, wherein the fuel cell is configured to provide the water vapor to the humidifying system.

12. The flameless heater system of claim 1, further comprising:

a telematics system operatively coupled to the control system, the telematics system being configured to transmit and receive parameters associated with the flameless heater system.

13. A method, comprising:

providing, to an energy source of a flameless heater system, fuel from a fuel source;

generating, by the energy source, power using the fuel from the fuel source;

providing, to a heating system operatively coupled to the energy source, a first portion of the generated power to be converted to heat;

providing, to a humidifying system operatively coupled to the energy source, a second portion of the generated power to be utilized to produce moisture;

generating, on a display screen, a user interface comprising a psychrometric chart, and receiving a user selection of a visible point on the psychrometric chart representing a selected temperature and a selected humidity; and adjusting, by a processing device, the power output of the energy source, the heat output of the heating system, and the moisture output of the humidifying system to generate air with the selected temperature and the selected humidity corresponding to the point on the psychrometric chart selected by a user.

14. The method of claim 13, further comprising:

receiving, by a control system of the flameless heater system, a temperature associated with the flameless heater system;

determining, by the control system, whether the temperature associated with the flameless heater system satisfies a temperature threshold associated with the selected temperature; and in response to determining that the temperature satisfies the temperature threshold, adjusting heat output of the heating system.

15. The method of claim 13, further comprising:

receiving, by a control system of the flameless heater system, a humidity associated with the flameless heater system;

determining, by the control system, whether the humidity associated with the flameless heater system satisfies a humidity threshold associated with the selected humidity; and in response to determining that the humidity satisfies the humidity threshold, adjusting moisture output of the humidity system.

16. The method of claim 13, further comprising:

receiving, by a control system of the flameless heater system, an adjustment to at least one of the heat or the moisture of the flameless heater system; and adjusting, by the control system, the at least one of the heat or the moisture of the flameless heater system based on the received adjustment.

17. The method of claim 13, further comprising:

transmitting, by the control system via a telematics system, one or more parameters associated with the flameless heater system to a client device;

receiving, from the client device, an adjustment to the one or more parameters associated with the flameless heater system; and adjusting the one or more parameters associated with the flameless heater system based on the received adjustment.

* * * * *